US011566786B2

(12) United States Patent
Gainanova

(10) Patent No.: US 11,566,786 B2
(45) Date of Patent: Jan. 31, 2023

(54) FACADE CONSTRUCTION WITH INTEGRATED LED LIGHT SOURCES

(71) Applicant: Svetlana Tavabilevna Gainanova, Ufa (RU)

(72) Inventor: Svetlana Tavabilevna Gainanova, Ufa (RU)

( * ) Notice: Subject to any disclaimer, the term of this patent is extended or adjusted under 35 U.S.C. 154(b) by 0 days.

(21) Appl. No.: 17/262,750

(22) PCT Filed: Apr. 16, 2019

(86) PCT No.: PCT/RU2019/050044
§ 371 (c)(1),
(2) Date: Jan. 25, 2021

(87) PCT Pub. No.: WO2020/022938
PCT Pub. Date: Jan. 30, 2020

(65) Prior Publication Data

US 2021/0254823 A1 Aug. 19, 2021

(30) Foreign Application Priority Data

Jul. 26, 2018 (RU) ..... 2018127621

(51) Int. Cl.
*F21V 33/00* (2006.01)
*E04B 2/96* (2006.01)
(Continued)

(52) U.S. Cl.
CPC ..... *F21V 33/006* (2013.01); *E04B 2/96* (2013.01); *F21V 23/002* (2013.01); *F21Y 2115/10* (2016.08)

(58) Field of Classification Search
CPC ..... F21V 33/006; F21V 23/002; E04B 2/96; F21Y 2115/10; E04F 13/072
See application file for complete search history.

(56) References Cited

U.S. PATENT DOCUMENTS 3,500,036 A 3/1970 Szentveri
5,297,012 A 3/1994 Fletcher
(Continued)

FOREIGN PATENT DOCUMENTS

DE 202006011788 U1 10/2006
RU 94257 U1 5/2010
(Continued)

*Primary Examiner* — Andrew J Coughlin
*Assistant Examiner* — Jessica M Apenteng

(57) ABSTRACT

The invention relates to a facade construction, consisting of panels and a framework in the form of vertical struts and horizontal girders covered by profiled covers. At the locations of intersection of the profiled covers, openings are formed for conducting lighting equipment cables, openings are formed in the frontal planes of the profiled covers for light sources, the openings being commensurable with the diameter of the light sources, and the light sources are located in the same plane as the front part of the profiled covers or project insignificantly beyond same. Separate groups of LED light sources can be connected in the internal volume of the profiled covers with the aid of a switching power-supply connector and switching control connector, and electrical power-supply sources and elements for controlling the light sources are mounted in the internal volume of the profiled covers or are located outside the construction system.

6 Claims, 4 Drawing Sheets

(51) Int. Cl.
*F21V 23/00* (2015.01)
*F21Y 115/10* (2016.01)

(56) References Cited

U.S. PATENT DOCUMENTS

| | | | | |
|---|---|---|---|---|
| 6,074,074 | A | 6/2000 | Marcus | |
| 8,615,937 | B1 | 12/2013 | Heim | |
| 8,721,106 | B2 | 5/2014 | Boissevain et al. | |
| 2003/0053307 | A1 | 3/2003 | Talamo | |
| 2003/0179574 | A1 | 9/2003 | Kuisma | |
| 2009/0147504 | A1 | 6/2009 | Teeters | |
| 2013/0201714 | A1 | 8/2013 | Huang-Tsai | |
| 2019/0327907 | A1* | 10/2019 | Ostman | A01G 13/0237 |
| 2020/0124238 | A1* | 4/2020 | Darras | G02B 6/009 |
| 2021/0095835 | A1* | 4/2021 | Gladden | F21V 5/007 |

FOREIGN PATENT DOCUMENTS

| | | | |
|---|---|---|---|
| RU | 2545206 | C2 | 3/2015 |
| RU | 164660 | U1 | 9/2016 |

* cited by examiner

FACADE CONSTRUCTION WITH INTEGRATED LED LIGHT SOURCES

TECHNICAL FIELD OF INVENTION

The present invention relates to the field of industrial and civil engineering, more particularly to translucent facade constructions of buildings and structures, which can be installed during the construction and reconstruction of buildings.

BACKGROUND

There are known translucent facade constructions consisting of glass or other panels and a framework, for example, the ALUTECH ALT F50 strut-girder system (source: https://alutech-group.com/product/profiles/altf50system/facad_altf50/)

The main elements of such a construction are vertical supporting struts on which horizontal girders are mounted, which take the main part of the load of the facade system. The device consists of an internal aluminium framework (struts and girders) and external clamp profiles. The strut-girder construction differs in that there are special aluminium pads (covers) on its outer side. This decorative element serves to cover the main clamping strips, which serve as fasteners for the insulated glass unit. The framework of the facade construction is located on the inner side of the wall and is practically invisible from the outside, therefore, from the outside, the facade looks like a single one-piece construction. The facade construction allows for designing large and small facade surfaces, shaping the appearance of the building, and providing protection against external weather influences and mechanical damages.

It is known that for illumination of facade surfaces during the night, as a rule, additional lighting structures, the appearance of which makes visual changes in the appearance of the facade during the day, are used. The supporting loads on the facade construction and the building itself increase, and light sources can create inconveniences to people in the building, since they are most often facing the building facade.

The task and technical result of the claimed present invention is the production of a technical means of defined purpose, more particularly of the facade construction with integrated LED light sources for its illuminating during the night, without reducing the main technical characteristics of the facade construction and without substantial increasing the supporting load on the construction of a building or structure.

DISCLOSURE OF INVENTION

A device is the construction of the strut-girder facade with LED light sources integrated therein.

LED light sources are located in the openings of the front planes of the vertical struts and horizontal girders, namely, in the profiles of decorative covers. The profile decorative cover of the strut-girder facade construction serves as a light construction body, protecting it against external influences, as well as a heat sink. At the locations of intersection of the profiled covers, openings are formed inside the profile thereof for conducting lighting equipment cables. The electrical and technical equipment of the light construction of the facade construction has a protection class of at least IP54, established for equipment exposed to atmospheric influences (according to GOST 14254-96 "Degrees of protection provided by enclosures (IP code)"), and can be used outdoors in any conditions. LED light sources are mounted in the openings in such a way that, while powered off, during the day, they are practically invisible from the outside and do not give rise to any confusion of the aesthetic perception of the facade, and all switching connectors (power-supply and controlling) as well as power-supply sources and elements for controlling the light sources are hidden in a hollow part of the profile of decorative covers of the facade construction or are carried outside the latter, for example, on the roof.

The design of the device does not require the use of an external additional system for fastening light and power-supply sources, does not entail a significant load on the facade of the building and does not interfere with the opening and closing of windows. The light from light sources does not hit the premises through window holes, does not blind people and does not bother in the evening and at night.

IMPLEMENTATION OF INVENTION

Figure 1:
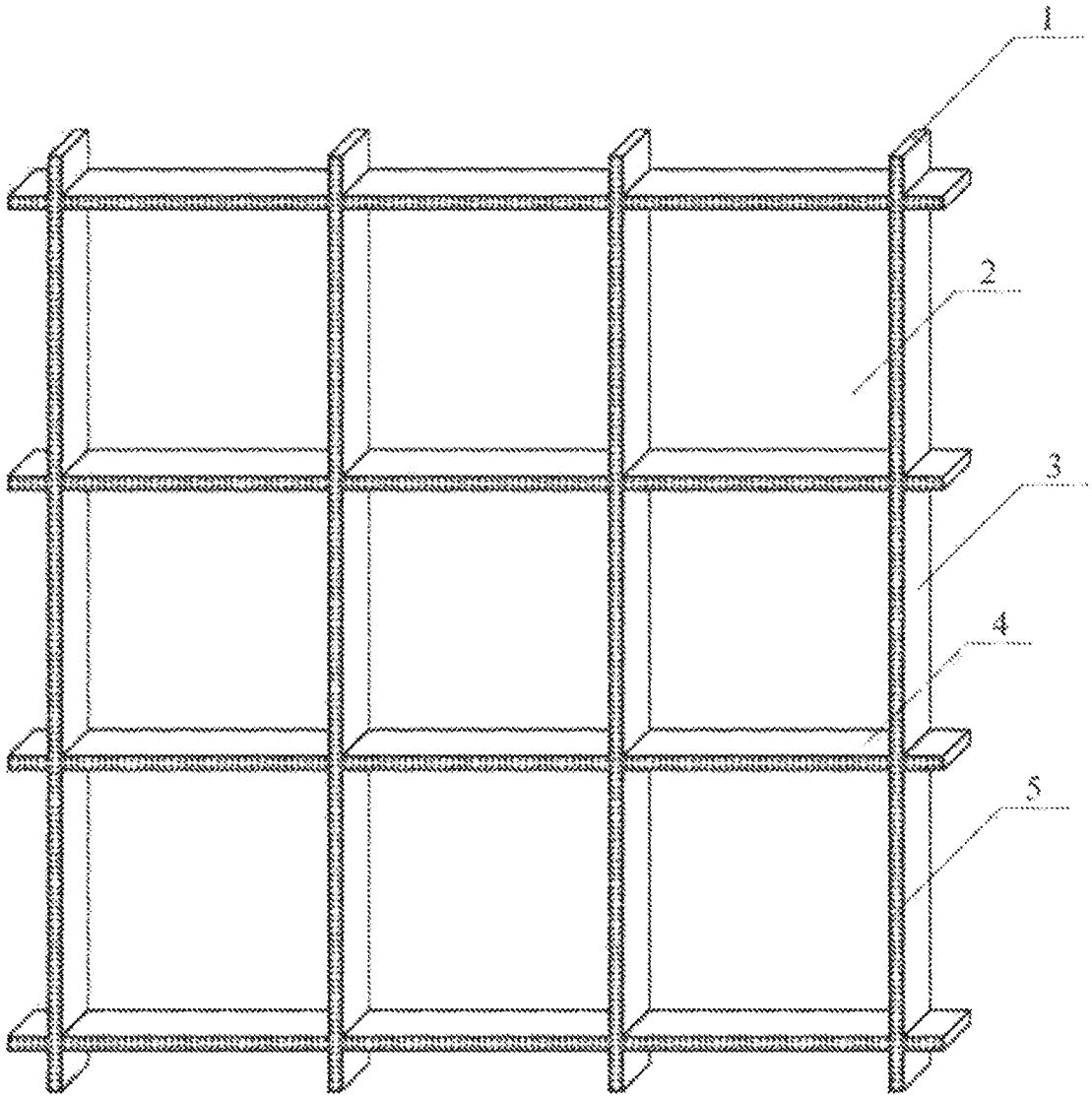
FIG. 1 shows a facade construction 1, consisting of facade panels 2 with vertical struts 3 and horizontal girders 4 covered outside by profiled decorative covers 5.
Figure 2:
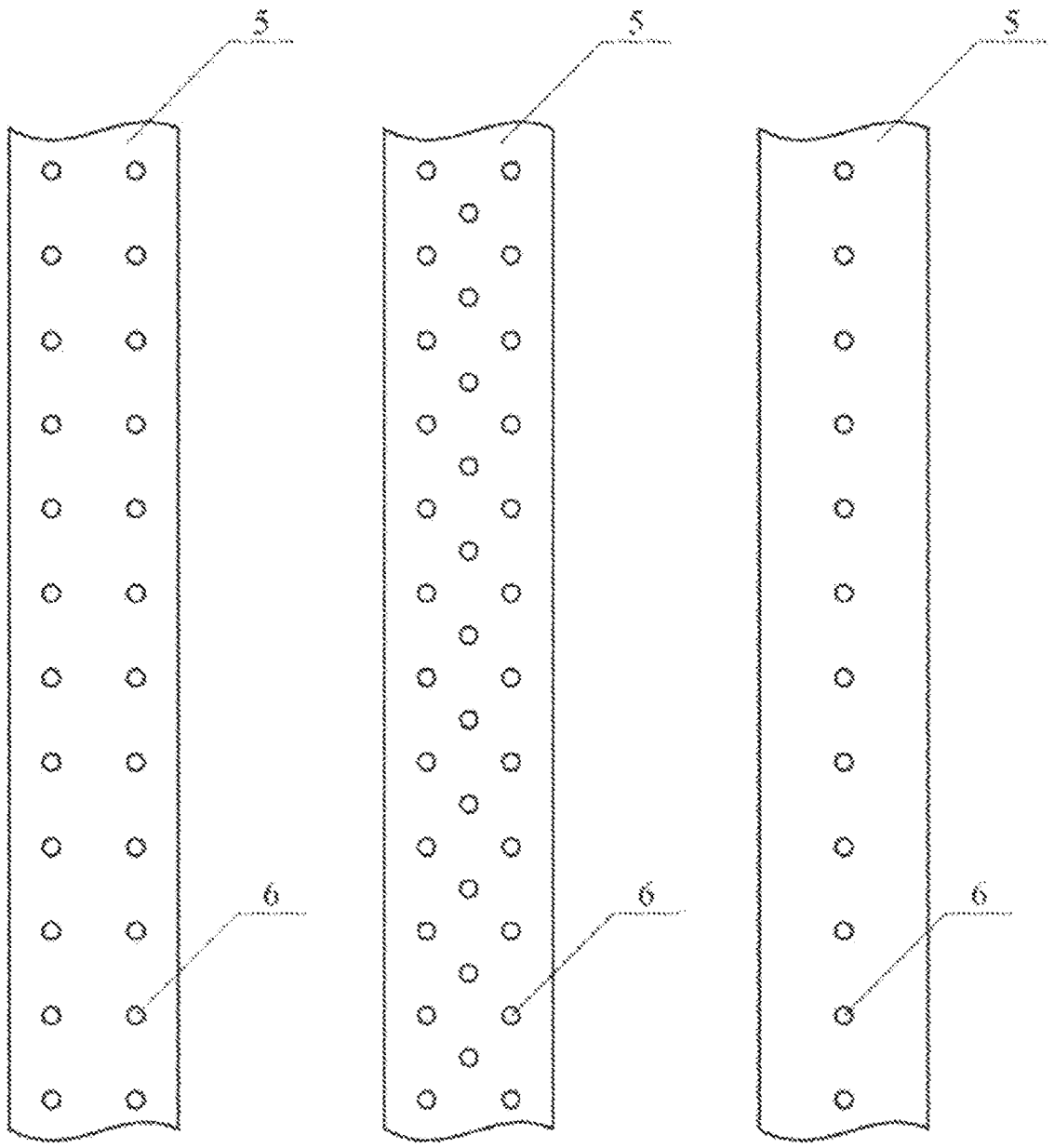
FIG. 2 shows, in particular, various options for the location of the openings on the front surface of the decorative cover 5, where LED light sources 6 are inserted. The outer surface of the decorative cover 5 can be flat or have various shapes.
Figure 3:
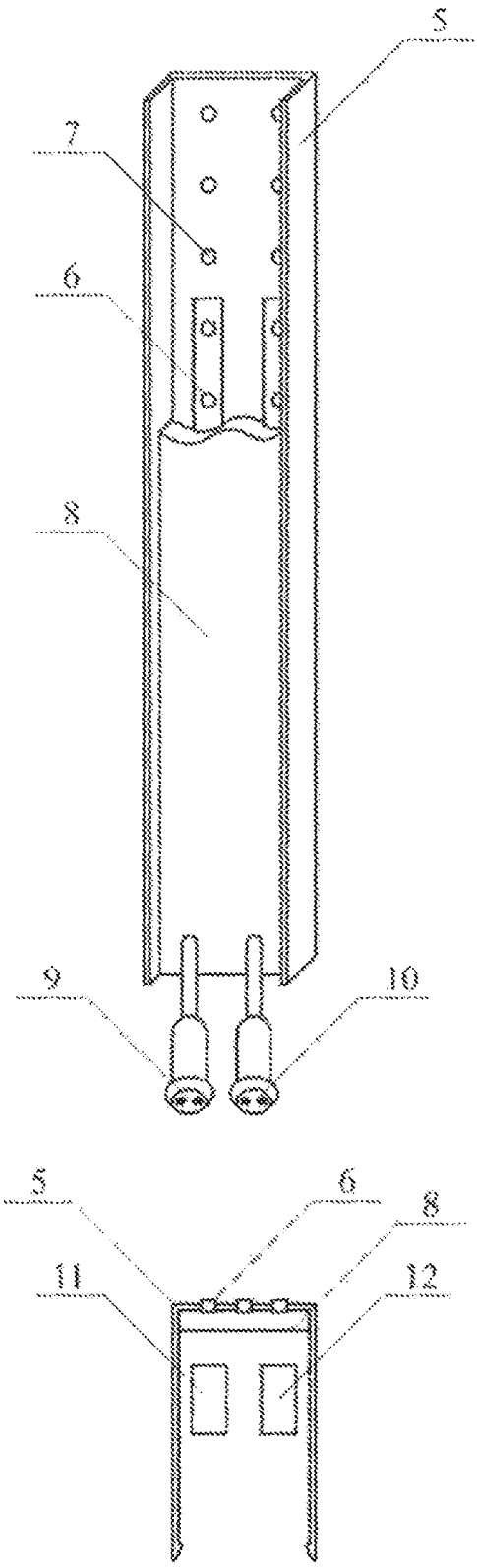
FIG. 3 shows how the lighting equipment and the lighting equipment cables are located in the profiled decorative cover 5. LED light sources 6 are mounted in the openings 7 of the decorative cover 5, which are fixed on a flexible tape or in another way. On top of the back of LED light sources 6, in particular, a compound 8 or another element or composition for dust and moisture protection can be applied. Separate groups of LED light sources 6 can be connected directly to each other or with the aid of a switching power-supply connector 9 and switching control connector 10. The power-supply system 11 and the light control system 12 are mounted behind decorative covers, or carried outside the facade system.
Figure 4:
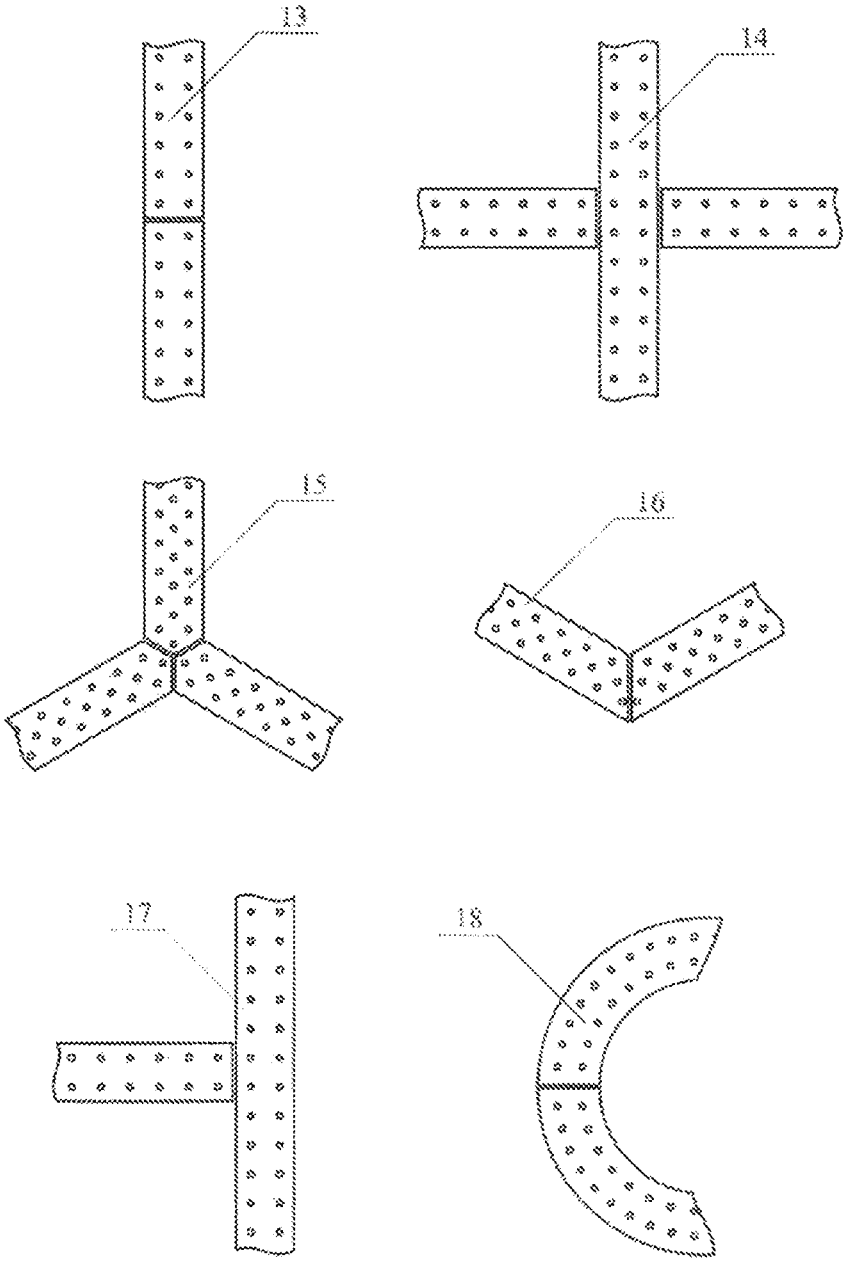
FIG. 4 shows, in particular, the variants of intersection of decorative covers 5: linear 13, cross 14, Y-shaped 15, angular 16, T-shaped 17, around the circumference 18.

Decorative covers with integrated LED light sources are installed on the facade system construction during the final stage of installation; along with the installation of decorative covers, the lighting equipment cables (power-supply sources and, if necessary, elements for controlling the LED sources) are mounted. Sequential connection of individual elements of the facade construction with light sources is possible. With the help of the light control system, architectural and artistic (decorative) lighting of the facade is carried out. Depending on the location of the light sources, it is possible to create, for example, a linear (contour) glow along the facade in places where the above-mentioned decorative covers are located, or create glow of only a part of the facade system (depending on the design solution). In the event of using full-color light sources, it is possible to control each source or a section of sources, which makes it possible to create various light scenarios on the facade (simultaneous colour change on the entire facade, separate colour change of light sources, brightness change, change in colour change speed, etc.).

The backlight system is used during the night and during the day the light sources integrated into the plane of the decorative cover are practically invisible and do not compromise the decorative integrity of the facade view.

What is claimed is:

1. A facade construction with integrated LED light sources, consisting of panels and a framework in the form of vertical struts and horizontal girders covered by profiled covers, wherein at the locations of intersection of the profiled covers first openings are formed for conducting lighting equipment cables, second openings are formed in frontal planes of the profiled covers for light sources, said second openings being commensurable with a diameter of the light sources.

2. The facade construction with integrated LED light sources according to claim 1, wherein the light sources are located in a same plane as a front part of the profiled covers.

3. The facade construction with integrated LED light sources according to claim 1, wherein the light sources project insignificantly beyond a plane of a front part of the profiled covers.

4. The facade construction with integrated LED light sources according to claim 1, wherein separate groups of LED light sources are connected in an internal volume of the profiled covers with the aid of a switching power-supply connector and a switching control connector.

5. The facade construction with integrated LED light sources according to claim 1, wherein cables and electrical power-supply sources and elements for controlling the light sources are mounted in an internal volume of the profiled covers.

6. The facade construction with integrated LED light sources according to claim 1, wherein cables and electrical power-supply sources and elements for controlling the light sources are located beyond the facade construction.

* * * * *